US010093885B2

(12) United States Patent
Agarkhed et al.

(10) Patent No.: US 10,093,885 B2
(45) Date of Patent: Oct. 9, 2018

(54) AQUEOUS COMPOSITION CONTAINING OLIGODYNAMIC METAL

(71) Applicant: Conopco, Inc., Englewood Cliffs, NJ (US)

(72) Inventors: Ajit Manohar Agarkhed, Maharashtra (IN); Nitish Kumar, Bihar (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/114,100

(22) PCT Filed: Jan. 26, 2015

(86) PCT No.: PCT/EP2015/051446
§ 371 (c)(1),
(2) Date: Jul. 26, 2016

(87) PCT Pub. No.: WO2015/113924
PCT Pub. Date: Aug. 6, 2015

(65) Prior Publication Data

US 2016/0348034 A1 Dec. 1, 2016

(30) Foreign Application Priority Data

Jan. 29, 2014 (EP) ..... 14152966

(51) Int. Cl.

| | |
|---|---|
| ***C11D 3/33*** | (2006.01) |
| ***C11D 3/12*** | (2006.01) |
| ***C11D 3/04*** | (2006.01) |
| ***C11D 3/20*** | (2006.01) |
| ***C11D 7/06*** | (2006.01) |
| ***C11D 7/20*** | (2006.01) |
| ***C11D 7/26*** | (2006.01) |
| ***C11D 7/32*** | (2006.01) |
| ***C11D 9/28*** | (2006.01) |
| ***C11D 3/30*** | (2006.01) |
| ***C11D 3/48*** | (2006.01) |
| ***C11D 9/18*** | (2006.01) |
| ***C11D 9/30*** | (2006.01) |

(52) U.S. Cl.
CPC ..... *C11D 3/1213* (2013.01); *C11D 3/044* (2013.01); *C11D 3/1206* (2013.01); *C11D 3/2075* (2013.01); *C11D 3/30* (2013.01); *C11D 3/33* (2013.01); *C11D 3/48* (2013.01); *C11D 7/06* (2013.01); *C11D 7/20* (2013.01); *C11D 7/265* (2013.01); *C11D 7/3245* (2013.01); *C11D 9/18* (2013.01); *C11D 9/28* (2013.01); *C11D 9/30* (2013.01)

(58) Field of Classification Search
None
See application file for complete search history.

(56) References Cited

U.S. PATENT DOCUMENTS

| | | | | |
|---|---|---|---|---|
| 3,050,467 | A | 8/1962 | Horowtiz et al. | |
| 4,477,438 | A | 10/1984 | Willcockson et al. | |
| 4,680,131 | A | 7/1987 | Busch et al. | |
| 4,988,453 | A | 1/1991 | Chambers et al. | |
| 6,730,643 | B2 | 5/2004 | Chokappa et al. | |
| 2006/0240122 | A1 | 10/2006 | Miner et al. | |
| 2007/0179079 | A1 | 8/2007 | Kilkenny et al. | |
| 2010/0143494 | A1 | 6/2010 | Scheuing et al. | |
| 2011/0224120 | A1* | 9/2011 | Meine ..... | C11D 1/04 510/337 |
| 2012/0034314 | A1 | 2/2012 | Levison et al. | |
| 2013/0102515 | A1 | 4/2013 | Hueffer et al. | |

FOREIGN PATENT DOCUMENTS

| | | |
|---|---|---|
| DE | 102009005791 | 1/2009 |
| EP | 0556957 | 8/1993 |
| EP | 2202289 | 6/2010 |
| WO | WO2004028461 | 4/2004 |
| WO | WO2010084057 | 7/2010 |
| WO | WO2011131422 | 10/2011 |

OTHER PUBLICATIONS

Search Report EP14152965, dated Jun. 4, 2014.
Written Opinion EP14152965, dated Jun. 4, 2014.
Surfactants, BASF SE, 2013, pp. 1-15; XP002737878; p. 2—line corresponding to the product Dehydol TL7.
Search Report in EP14152966, dated Jul. 9, 2014, pp. 1-2, EP.
Search Report in EP14152967, dated Jul. 7, 2014, pp. 1-2, EP.
Search Report in PCTEP2015050079, dated Mar. 31, 2015.
Search Report in PCTEP2015050107, dated May 4, 2015.
Search Report in PCTEP2015051446, dated Apr. 15, 2015.
Written Opinion in EP14152966, dated Jul. 21, 2014, EP.
Written Opinion in EP14152967, dated Jul. 21, 2014, pp. 1-2, EP.
Written Opinion in PCTEP2015050079, dated Mar. 31, 2015.
Written Opinion in PCTEP2015050107, dated May 4, 2015.
Written Opinion in PCTEP2015051446, dated Apr. 15, 2015.

* cited by examiner

*Primary Examiner* — Nicholus Ogden, Jr.
(74) *Attorney, Agent, or Firm* — Ronald A. Koatz

(57) ABSTRACT

Disclosed is an aqueous composition having viscosity from 1 to 100 cP at 20° C., said composition comprising: (i) an oligodynamic metal or ions thereof; (ii) a chelating agent; and, (iii) free alkali less than 1 wt %, wherein said composition comprises 0.01 wt % to 2 wt % of a salt of an organic acid; pH of the composition is from 9 to 12 and molar ratio of said oligodynamic metal to said chelating agent is 1:0.25 to 1:10. The composition provides a robust solution for technical problems of discoloration and instability.

9 Claims, No Drawings

AQUEOUS COMPOSITION CONTAINING OLIGODYNAMIC METAL

FIELD OF THE INVENTION

The invention relates to aqueous compositions of oligodynamic metals, especially silver.

BACKGROUND OF THE INVENTION

There is a growing demand for antimicrobial cleansing compositions. Antimicrobial soap bars and cleansers for hand and body are increasingly being preferred by consumers.

Antimicrobial cleansing compositions containing oligodynamic metal like silver, copper or zinc are very effective against a variety of bacteria. Silver is used most widely. However some metals, especially silver, are particularly prone to destabilisation upon exposure to high pH, heat and strong sunlight discolouration, agglomeration or even phase separation under extreme conditions.

Usually such metals are included at ppm or even ppb (parts per million/parts per billion) levels which make it imperative to ensure that the least amount is rendered inactive.

It generally is also difficult to ensure uniform distribution of silver within the matrix of the composition.

This led to the development of aqueous premix compositions which are used as delivery vehicles.

The liquidy base of such compositions makes it easy to dose and distribute the oligodynamic metal with greater precision.

However discoloration, especially of Silver is still a problem, as some of the known methods do not provide a robust, effective and long-lasting solution.

US2006240122 A1 (Miner Edwin) discloses that polypectate and EDTA (a chelator) can be used to stabilise silver ions and prolong the antimicrobial effect. It is also disclosed that chelated silver disperses better than non-chelated silver. The polypectate chelates with free calcium and magnesium ions. The complex is prepared by first preparing an ammoniacal silver nitrate mixture. The application also discloses a liquid antiseptic composition containing water, silver ions, polypectate and EDTA.

US2012034314 A1 (Levison Lisa Turner) discloses that a fixative polymer Polyquaternium-69 can bind the chelated metal ions to the skin for an extended period. The chelated silver compound (e.g. silver acrylate) is suspended in the polymer to form a tacky liquid.

US2011224120 AA (Henkel) discloses that silver ions can be stabilised by using non-neutralized fatty acids.

US 2010/0143494 (Clorox) discloses an antimicrobial composition containing a soluble silver salt and an alkanolamine or aminoalcohol. The composition may additionally contain an amino acid or amino acid salt and surfactant. The composition has additional stability and activity compared to prior art silver complexes.

There is an unmet need for a robust solution for the technical problem of discolouration. There is also a need for a solution for the problem of instability.

SUMMARY OF THE INVENTION

We have determined that stability of alkaline aqueous compositions containing an oligodynamic metal can be markedly improved and tendency to discolour can also be controlled by lowering the free alkali content of the composition by the addition of an organic acid. A portion of the acid turns into a salt in view of alkaline nature of the composition.

In accordance with a first aspect is disclosed an aqueous composition having viscosity in the range of 1 to 100 cP at 20° C., said composition comprising:

(i) an oligodynamic metal or ions thereof;

(ii) a chelating agent; and, (iii) free alkali content less than 1 wt %, wherein the composition comprises 0.01 wt % to 2 wt % of a salt of an organic acid; pH of the composition is from 9 to 12 molar ratio of said oligodynamic metal to said chelating agent is 1:0.25 to 1:10.

In accordance with a second aspect is disclosed the use of a salt of an organic acid for stabilising the colour of an aqueous composition having viscosity from 1 to 100 cP at 20° C. and comprising an oligodynamic metal, a chelating agent and free alkali less than 1 wt %.

The invention will now be explained in detail.

DETAILED DESCRIPTION OF THE INVENTION

Silver, zinc, copper and some other oligodynamic materials are used widely in antimicrobial compositions. However, oxides and some salts of such metals, especially Silver, are sensitive to pH, heat and light. Under such conditions, the metal tends to discolour to form brown, gray or black particles. The particles become prone to settling and/or agglomeration.

Chelating agents such as EDTA (Ethylene diamine tetraacetic acid) and DTPA (Diethylene triamine pentaacetic acid) lend some degree of stability to the colour of the composition but their effect is limited. This manifests itself as a gradual but perceivable change in colour of the particles and often also that of the composition itself towards darker shades.

As disclosed in the background section, silver and such other metals are usually dosed at very low levels. Distribution of the metal is usually uniform in liquid compositions like handwash soaps, bodywash preparations and shampoos. However it is difficult to ensure homogenous distribution of the small amount throughout the matrix of the composition when it comes particularly to solid compositions like soap bars. Aqueous premix compositions offer a somewhat good solution but such compositions have limited shelf life in view of their general tendency to agglomerate and discolour.

We have determined the role of free alkali content on stability of the composition. Colour stability is significantly better at free alkali content less than 1 wt %.

Without wishing to be bound by theory it is believed that lower free alkali content causes minimal disturbance to the ionic equilibrium of the chelated metal ions.

It is believed that lower free alkalinity content renders the chelated metal ions lesser prone to reduction keeping them in solution, thereby providing a simple and effective method to stabilise the colour. Surprisingly, it has also been determined that bars of soap, particularly cast melt soap, made by using the disclosed composition as a delivery vehicle had highly uniform distribution of the oligodynamic metal content, especially Silver.

The precise mechanism of discoloration of consumer products especially soap bars containing such metals, particularly silver, is also not well understood. It is hypothesised that solubility of compounds such as silver oxide increases with alkalinity leading to formation of silver hydroxide which subsequently forms other silver compounds such as silver soaps which are darker in colour. Conversely, it is believed that when alkalinity is controlled, it helps retain most of silver in its active form.

In view of enhanced colour and physical stability, the compositions, especially premix compositions, can be stored for longer periods and this technical benefit helps overcome a major supply chain constraint as the compositions can be prepared in bulk and can also be transported over long distance without worrying about fluctuations in climatic conditions.

Oligidynamic Metal

Oligodynamic effect (also called as oligodynamic action) is the effect of inhibiting, or killing micro-organisms by use of very small amounts of a chemical substance. Several metals exhibit such effect. Preferred metals are silver, copper, zinc, gold or aluminium. Silver is particularly preferred. In the ionic form it may exist as a salt or any compound in any applicable oxidation state.

Preferred embodiments of the aqueous composition have 10 to 6000 ppm of the oligodynamic metal. Further preferred compositions have 100 to 3000 ppm, more preferred compositions have 0.001 to 10 wt % of the oligodynamic metal. More preferred embodiments have 0.01 to 5 wt % and yet further preferred embodiments have 0.1 to 2 wt % oligodynamic metal. Where the metal is present in the form of a compound such as Silver in the form of Silver acetate; then an appropriate amount of the compound is included so that the active metal content is within the broad and preferred ranges.

Preferred Compounds of Silver

Preferred silver compounds are water-soluble Silver(I) compounds having a Silver ion solubility at least $1.0\times10^{-4}$ mol/L (in water at 25° C.). Silver ion solubility, as referred to herein, is a value derived from a solubility product (Ksp) in water at 25° C., a well known parameter that is reported in numerous sources. More particularly, silver ion solubility [Ag+], a value given in mol/L may be calculated using the formula:

$$[Ag+]=(Ksp\cdot x)^{(1/(x+1))}$$

wherein Ksp is the solubility product of the compound of interest in water at 25° C., and x represents the number of moles of silver ion per mole of compound. It has been found that Silver(I) compounds having a silver ion solubility of at least $1\times10^{-4}$ mol/L in are suitable for use herein. Silver ion solubility values for a variety of silver compounds are given in Table 1:

TABLE 1

| Silver Compound | X | Ksp (mol/L in water at 25 ° C.) | Silver Ion Solubility [Ag+] (mol/L in water at 25° C.). |
|---|---|---|---|
| silver nitrate | 1 | 51.6 | 7.2 |
| Silver acetate | 1 | $2.0 \times 10^{-3}$ | $4.5 \times 10^{-2}$ |
| Silver sulfate | 2 | $1.4 \times 10^{-5}$ | $3.0 \times 10^{-2}$ |
| Silver benzoate | 1 | $2.5 \times 10^{-5}$ | $5.0 \times 10^{-3}$ |
| Silver salicylate | 1 | $1.5 \times 10^{-5}$ | $3.9 \times 10^{-3}$ |
| Silver carbonate | 2 | $8.5 \times 10^{-12}$ | $2.6 \times 10^{-4}$ |
| Silver citrate | 3 | $2.5 \times 10^{-16}$ | $1.7 \times 10^{-4}$ |
| Silver oxide | 1 | $2.1 \times 10^{-8}$ | $1.4 \times 10^{-4}$ |
| Silver phosphate | 3 | $8.9 \times 10^{-17}$ | $1.3 \times 10^{-4}$ |
| Silver chloride | 1 | $1.8 \times 10^{-10}$ | $1.3 \times 10^{-5}$ |
| Silver bromide | 1 | $5.3 \times 10^{-13}$ | $7.3 \times 10^{-7}$ |
| Silver iodide | 1 | $8.3 \times 10^{-17}$ | $9.1 \times 10^{-9}$ |
| Silver sulfide | 2 | $8.0 \times 10^{-51}$ | $2.5 \times 10^{-17}$ |

Preferred silver(I) compounds are silver oxide, silver nitrate, silver acetate, silver sulfate, silver benzoate, silver salicylate, silver carbonate, silver citrate and silver phosphate, with silver oxide, silver sulfate and silver citrate being of particular interest in one or more embodiments. In at least one preferred embodiment the silver(I) compound is silver oxide.

The silver compound is preferably not in the form of nano particles, attached to nano particles or part of intercalated silicates such as, for example, bentonite.

Chelates are characterized by coordinate covalent bonds. These occur when unbonded pairs of electrons on non-metal atoms like nitrogen and oxygen fill vacant d-orbitals in the metal atom being chelated. Valence positive charges on the metal atom can be balanced by the negative charges of combining amino acid ligands. The bonding of an electron pair into vacant orbitals of the metal allows for more covalent bonding than the valence (or oxidation number) of the metal would indicate. Forming bonds this way is called coordination chemistry. This allows chelates to form, providing that the ligands can bond with two or more moieties within the same molecule and providing that proper chemistry promoting chelation is present. An important factor is the strength of the complex formed between the metal ion and the chelating agent. This determines whether the complex will be formed in the presence of competing anions. The stability or equilibrium constant (K), expressed as log K, has been determined for many metals and chelating agents. The higher the log K values, the more tightly the metal ion will be bound to the chelating agent and the more likely that the complex will be formed.

Preferred chelating agent is selected from ethylene diamine tetraacetic acid (EDTA), ethylene diamine dissuccinate (EDDS), N,N-bis(carboxymethyl) glutamic acid (GLDA), Diethylenetriaminepentaacetic acid (DTPA), Nitrilotriacetic acid (NTA) or Ethanoldiglycinic acid ((EDG). Chelating agents are usually used in the form of their salts with a metal. For example, EDTA is used in the form of disodium or tetrasodium salt. Accordingly it is preferred to use a salt form of a chelating agent over the natural acid form. It is also preferred that the chelating agent is present in a fully neutralized form such as tetrasodium-EDTA.

In preferred embodiment of the composition the molar ratio of the metal to the chelating agent is in the range of 1:0.25 to 1:10 and more preferably in the range of 1:0.5 to 1:5.

In another preferred embodiment of the composition the molar ratio of said metal to said salt of organic acid is 1:0.05 to 1:5.

Preferred embodiments of the composition are clear and transparent but they could also be translucent or opaque. Clarity or transparency is measured in NTU (Nephelometric Turbidity Units). It is preferred that turbidity of preferred compositions, as measured on the NTU scale, is less than 100 NTU, more preferably less than 50 NTU, most preferably less than 30 NTU and optimally in the range of 0.01 to 10 NTU. Usually turbidity is measured at 25° C.

Free alkali content of the composition is less than 1%. It is believed that the organic acid helps maintain a constant concentration of the metal, particularly silver, even upon prolonged storage.

The composition has 0.01 wt % to 2 wt % of a salt of an organic acid. A preferred organic acid is a carboxylic acid, an amino acid, a sulphonic acid or an alpha-hydroxy acid. It is particularly preferred that the carboxylic acid is a fatty acid having 6 to 18 carbon atoms. The organic acid provides the requisite stability while causing minimum disturbance to the ionic equilibrium of chelation so that the chelating strength is affected to the minimal extent. Inorganic or strong mineral acids are not preferred because it is believed that use of such acids advsersely affects stability. In view of alkaline nature of the composition, part of the acid turns into its salt. Some acid may remain in the acid form.

The pH of preferred embodiment of the composition is from 9 to 12, more preferably 10 to 12 and optimally 11 to 12.

In the case of compositions which are not stable enough, there is gradual but perceivable colour changes from an initial to pink, red and thereafter brown.

Therefore in the case of preferred embodiments of the composition, the "Red" component of the colour of the composition as measured on the LOVIBOND RYBN colour scale is less than 10, more preferably less than 8.

Lovibond® Scale is based on 84 calibrated glass colour standards of different densities of magenta (red), yellow, blue and neutral, graduating from desaturated to fully saturated. Sample colours are matched by a suitable combination of the three primary colours together with neutral filters, resulting in a set of Lovibond® RYBN units that define the colour. The preferred value of 8 for the "R" component indicates that the preferred compositions are prone to minimal discolouration. The Lovibond® Scale provides a simple language of colour which can fully describe the appearance of any colour in the least possible number of words and figures to avoid language difficulties. For convenience of laboratory records, or in communicating readings between laboratories, many industries record their results on a three colour basis, quoting the Red, Yellow and Blue instrumental values. Range: 0-70 Red, 0-70 Yellow, 0-40 Blue, 0-3.9 Neutral. Path Length: 1 to 153 mm (1/16"-6").

Surfactants

It is preferred that the disclosed aqueous composition is surfactant-free. By surfactant free is meant that the compositions may contain up to 3 wt %, more preferably less than 1 wt % and most preferably less than 0.5 wt %. The term surfactant includes anionic, non-ionic, cationic and other surfactants. Anionic surfactants include sulphonates, ethoxylated sulphonate and soap based surfactants.

However, the aqueous composition may be used as a delivery vehicle for the oligodynamic metal in any surfactant-based cleanser such as bodywash or shower gel and soap bars.

Process

In accordance with a second aspect is disclosed a process for preparing an aqueous composition of the first aspect comprising the steps of:

(i) heating an aqueous mixture comprising a chelating agent and a compound of a metal having oligodynamic property to 30° C. to 85° C.; and, (ii) adding an organic acid to said aqueous mixture to bring the free alkali content of said composition, measured as NaOH, to less than 1 wt %.

It is believed that the acid provides longer term stability. It is observed that in the absence of an acid, the concentration of the metal, especially silver, reduces gradually upon storage presumably on account of agglomeration and settling. Addition of acid is believed to keep the metal ions in solution and thus the concentration of silver remains more or less constant. In a preferred embodiment of the process, the step (i) is carried for up to 60 minutes.

In accordance with yet another aspect is disclosed an aqueous composition of the first aspect obtainable by the steps of:

(i) heating an aqueous mixture comprising a chelating agent and a compound of a metal having oligodynamic property to 30° C. to 85° C.; and, (ii) adding an organic acid to said aqueous mixture to bring the free alkali content of said composition, measured as NaOH, to less than 1 wt %.

In a preferred embodiment of the process the quantity of the compound of the metal in the aqueous mixture is at a level equivalent to 10 to 6000 ppm of the metal. In a preferred embodiment of the process, in the aqueous mixture, the molar ratio of metal to chelating agent is in the range of 1:0.25 to 1:10 and more preferably in the range of 1:0.05 to 1:5.

In accordance with a yet further aspect is disclosed the use of a salt of an organic acid for stabilising the colour of an aqueous composition having viscosity from 1 to 100 cP at 20° C. and comprising an oligodynamic metal or ions thereof, a chelating agent and free alkali less than 1 wt %.

Cleansing Composition

In one aspect the aqueous composition of the invention can be used as a premix for the manufacture of other compositions, such as a cleansing composition. Non-limiting examples thereof include handwash liquids, bodywash liquids, bathing bars, soap bars, hand-sanitizers, shower gels, shampoo, floor cleansers and hard surface cleaning compositions.

Soap bars/tablets can be prepared using manufacturing techniques described in the literature and known in the art for the manufacture of soap bars. Examples of the types of manufacturing processes available are given in the book Soap Technology for the 1990's (Edited by Luis Spitz, American Oil Chemist Society Champaign, Ill. 1990). These broadly include: melt forming, extrusion/stamping, and extrusion, tempering, and cutting. A preferred process is extrusion and stamping because it provides high quality bars.

The soap bars may, for example, be prepared by either starting with or forming the soap in situ. When employing the fatty acid or acids that are the precursors of the soap as starting ingredients such acid or acids may be heated to temperature sufficient to melt same and typically at least 80° C. and, more particularly from 80° C. to below 100° C., and neutralized with an suitable neutralizing agent or base, for example, sodium hydroxide, commonly added as a caustic solution. The neutralising agent is preferably added to the melt in an amount sufficient to fully neutralise the soap-forming fatty acid and, in at least one embodiment, is preferably added in an amount greater than that required to substantially completely neutralize such fatty acid.

Following neutralisation, excess water may be evaporated and additional composition components, including silver (I) compound added is preferably added. Though not necessary, it is preferred that a carrier, preferably talc, glycerin or triethylamine is used to add the Silver (I) compound. Desirably the water content is reduced to a level such that, based on the total weight thereof, the resulting bars contain no more that 25% by weight, preferably no more than 20% by weight, more preferably no more than 18% by weight of water, with water contents of from 8 to 15% by weight being typical of many bars. In the course of processing, either as part of neutralisation and/or subsequent thereto, the pH may be adjusted, as needed, to provide the high pH of at least 9 which is desired for the subject bars.

The resulting mixture may be formed into bars by pouring the mixture, while in a molten state into molds or, by amalgamation, milling, plodding and/or stamping procedures as are well known and commonly employed in the art.

In a typical process, the mixture is extruded through a multi-screw assembly and the thick liquid that exits therefrom, which typically has a viscosity in the range of 80,000 to 120,000 cPs, is made to fall on rotating chilled rolls. When the viscous material falls on the chilled rolls, flakes of soap are formed. These flakes are then conveyed to a noodler plate for further processing. As the name suggests, the material emerging from this plate is in the form of noodles. The noodles are milled, plodded and given the characteristic shape of soap bars.

The bars may also be made by a melt cast process and variations thereof. In such process, saponification is carried out in an ethanol-water mixture (or the saponified fatty acid is dissolved in boiling ethanol). Following saponification other components may be added, and the mixture is preferably filtered, poured into molds, and cooled. The cast composition then undergoes maturation step whereby alcohol and water are reduced by evaporation over time. Maturation may be of the cast composition or of smaller billets, bars or other shapes cut from same. In a variation of such process described in U.S. Pat. No. 4,988,453 B1 and U.S. Pat. No. 6,730,643 B1, the saponification is carried out in the presence of polyhydric alcohol and water, with the use of volatile oil in the saponification mixture being reduced or eliminated. Melt casting allows for the production of translucent or transparent bars, in contrast to the opaque bars typically produced by milling or other mechanical techniques.

Moulding or casting is a well-known method for making soap bars, especially transparent framed soap. To enable casting the composition should be capable of being molten without charring at reasonable temperatures, say in the range of 60 to 150° C., and should turn solid when cooled. Casting was traditionally carried out in unitary moulds which were filled with molten composition and cooled to form tablets of soap.

Melt Cast Soap Bars Containing an Oligodynamic Metal

Melt cast soap bars are generally moulded in a Schicht cooler which is a device having plurality of elongated. Oligodynamic metals such as silver are usually added at very low levels making it difficult to ensure uniform distribution of the metal in the bar composition. This non-uniformity manifests itself as bars (of melt cast soap) containing varying levels of silver and the variation from mean level (or the expected level) is usually as high as 60 to 70%. For example, when the expected mean level is 10 ppm, bars containing 3 ppm and 4 ppm silver may also be found.

However, it has been observed that notwithstanding the low metal content, bars of soap, especially, melt cast soap, made by using a preferred embodiment of the aqueous composition in the form of delivery vehicle for an oligodynamic metal such as silver were found to have significantly lower variation in silver content as seen with samples picked at random. The mechanism for uniform distribution is not well understood.

EXAMPLES

The following non-limiting examples are provided to further illustrate the invention; the invention is not in any way limited thereto.

Example 1: Effect of Free Alkali

An aqueous mixture of Silver oxide (1.5 g) and 50 g DTPA was heated to 60° C. Thereafter, an organic acid was added in experimental compositions (see tables 2 and 3) and it was not added in the case of comparative compositions (see tables 2 and 3). The compositions were diluted with water.

The basic formulation of the finished product and some important physical and chemical properties are shown in table 2:

TABLE 2

| Ingredient | Content/wt % |
|---|---|
| Silver oxide | 0.5 |
| Diethylene triamine pentaacetic acid pentasodium salt | 1.0 |
| Free alkalinity | 0.05 |
| Distilled water | Balance to 100 |
| Viscosity | 2 cP at 20° C. |
| pH | 11 |
| Surfactant content | 0 |

Bars of the composition of table-2 were subjected to storage stability test as a control composition. It was stored at 50° C. for one week. At the end of the period, the colour was measured on Lovibond® tintometer using a 2-inches cell. The observations are presented in table-3. The table 3 also contains information about the added organic acid (and the consequent the wt % of the salt formed) observations which were recorded for some of the preferred embodiments of the composition which were also tested in the same manner.

TABLE 3

| | Before storage | | After 3 months storage | |
|---|---|---|---|---|
| Composition | LOVIBOND "R" | Precipitation | LOVIBOND "R" | Precipitation |
| No. 1<br>No lauric acid<br>No salt | 5.5 | Yes | 15 | Yes |
| No. 2<br>0.1% lauric acid<br>0.02% sodium laurate | 0.1 | No | 1 | No |
| No. 3<br>0.15% lauric acid<br>0.02% sodium laurate | 0 | No | 0.5 | No |
| No. 4<br>0.1% citric acid<br>0.03% sodium citrate | 0.2 | No | 1 | No |

The data clearly indicates the technical benefits of colour stability and the physical stability. Composition 1 (which may be called as comparative composition), was least stable.

Example-2: Melt Cast Soap Bars and Uniform Distribution of Silver

Several billets of cast soap were made on a Schicht cooler. The basic formulation is shown in table 4. Each billet was cut into bars of standard size.

TABLE 4

| | Composition/wt % | |
|---|---|---|
| Ingredient | A (comparative) | B |
| Water | 17.0 | 17.0 |
| Sodium Palm Kernelate | 15.0 | 15.0 |

TABLE 4-continued

| Ingredient | Composition/wt % A (comparative) | B |
|---|---|---|
| Sodium Palmate | 14.0 | 14.0 |
| Sorbitol | 12.0 | 12.0 |
| Glycerin | 10.0 | 10.0 |
| Propylene Glycol | 6.0 | 6.0 |
| Sodium Lauryl Sulphate | 4.0 | 4.0 |
| PEG-4 | 4.0 | 4.0 |
| Isopropyl alcohol | 3.0 | 3.0 |
| Sodium Chloride | 1.0 | 1.0 |
| Perfume | 0.8 | 0.8 |
| Silver Oxide (having theoretical Silver content of) | 0.001* | 0.001** |
| Penta sodium pentetate (DTPA) | 0.01 | 0.01 |

Note:
*added in the form of composition No. 1 of table 3
**added in the form of composition No. 2 of table 3

Four samples of A and four of B were drawn randomly. Silver content was estimated by standard method. Observations are shown in table-5 below.

TABLE 5

| Bar no. (Comparative) | Silver/ppm | Bar no. (Experimental) | Silver/ppm |
|---|---|---|---|
| A1 | 9 | B1 | 8.5 |
| A2 | 6 | B2 | 9.0 |
| A3 | 3 | B3 | 8.8 |
| A4 | 4 | B4 | 9.1 |

The observations of table 5 read with the information of tables 3 and 4 very clearly indicate the wide-ranging silver content in comparative bars. On the other hand, the uniform distribution of Silver in bars made by using a preferred embodiment of the aqueous composition is also very apparent.

The illustrated examples indicate that the preferred compositions provide a robust solution for technical problems of discolouration and instability.

The invention claimed is:

1. An aqueous composition having viscosity from 1 to 100 cP at 20° C., said composition comprising:

(i) an oligodynamic metal or ions thereof;

(ii) a chelating agent; and, (iii) free alkali less than 1 wt %, wherein said composition comprises 0.01 wt % to 2 wt % of a salt of an organic acid; pH of the composition is from 9 to 12 and molar ratio of said oligodynamic metal to said chelating agent is 1:0.25 to 1:10;

wherein said composition comprises 3% by wt. or less surfactant.

2. A composition as claimed in claim 1 wherein the Red component at the LOVIBOND RYBN colour scale of said composition is not more than 10.

3. A composition as claimed in claim 1 comprising 0.001 to 10 wt % of said oligodynamic metal or ions thereof.

4. A composition as claimed in claim 1 wherein said oligodynamic metal is Silver, Copper, Zinc or Gold.

5. A composition as claimed in claim 4 wherein said metal is Silver.

6. A composition as claimed in claim 1 wherein said chelating agent is selected from ethylene diamine tetraacetic acid (EDTA), ethylene diamine dissuccinate (EDDS), N,N-bis(carboxymethyl) glutamic acid (GLDA), Diethylenetriaminepentaacetic acid (DTPA), Nitrilotriacetic acid (NTA) or Ethanoldiglycinic acid ((EDG).

7. A composition as claimed in claim 1 wherein molar ratio of said metal to said salt of organic acid is 1:0.05 to 1:5.

8. A process for preparing an aqueous composition as claimed in claim 1 comprising the steps of:

(i) heating an aqueous mixture comprising a chelating agent and a compound of a metal having oligodynamic property to 30° C. to 85° C.; and, (ii) adding an organic acid to said aqueous mixture to bring the free alkali content of said composition, measured as NaOH, to less than 1 wt %.

9. An aqueous composition as claimed in claim 1 obtainable by the steps of:

(i) heating an aqueous mixture comprising a chelating agent and a compound of a metal having oligodynamic property to 35° C. to 85° C.; and, (ii) adding an organic acid to said aqueous mixture to bring the free alkali content of said composition, measured as NaOH, to less than 1 wt %.

* * * * *